US005549469A

United States Patent [19]

Wild et al.

[11] Patent Number: 5,549,469

[45] Date of Patent: Aug. 27, 1996

[54] MULTIPLE BURNER CONTROL SYSTEM

[75] Inventors: Gary G. Wild, Rockford, Ill.; John D. Eley, Beloit, Wis.

[73] Assignee: Eclipse Combustion, Inc., Rockford, Ill.

[21] Appl. No.: 374,164

[22] Filed: Jan. 17, 1995

Related U.S. Application Data

[63] Continuation-in-part of Ser. No. 203,170, Feb. 28, 1994.

[51] Int. Cl.[6] ..... F23M 9/00

[52] U.S. Cl. ..... 431/75; 431/79; 431/80; 431/72

[58] Field of Search ..... 431/75, 76, 77, 431/78, 79, 80, 74, 72, 90, 18, 202, 2, 69

[56] References Cited

U.S. PATENT DOCUMENTS

| | | | |
|---|---|---|---|
| 3,266,026 | 8/1966 | Plambeck | 340/228 |
| 3,437,884 | 4/1969 | Mandock et al. | 317/148 |
| 3,500,469 | 3/1970 | Plambeck et al. | 340/228 |
| 3,817,687 | 6/1974 | Cavallero et al. | 431/202 |
| 3,905,126 | 9/1975 | Villalobos et al. | 34/72 |
| 4,000,961 | 1/1977 | Mandock | 431/2 |
| 4,815,965 | 3/1989 | Linkins, Jr. | 431/75 X |
| 4,938,684 | 7/1990 | Karl et al. | 431/75 X |
| 5,026,272 | 6/1991 | Takahashi et al. | 431/79 |
| 5,077,550 | 12/1991 | Cormier | 431/79 |
| 5,161,963 | 10/1992 | Berlincourt | 431/78 |
| 5,203,687 | 4/1993 | Oguchi | 431/76 X |
| 5,249,954 | 10/1993 | Allen et al. | 431/75 X |

FOREIGN PATENT DOCUMENTS

| | | |
|---|---|---|
| 2344934A1 | 3/1975 | Germany . |
| 4027090A1 | 3/1992 | Germany . |
| 1276672 | 6/1972 | United Kingdom . |

OTHER PUBLICATIONS

"Single and Multi–Burner Solid State Protectofier Combustion Safeguard", Bulletin P–24–R, Form 6642V, of Protection Controls, Inc. in Skokie, Illinois.

"Sens–A–Flame II Single–& Multi–Burner Combustion Safeguard", brochure of Pyronics, Inc. in Cleveland, Ohio.

"Electronic Flame Supervision", brochure of Pyronics, Inc. in Cleveland, Ohio.

*Primary Examiner*—Larry Jones

*Attorney, Agent, or Firm*—Leydig, Voit & Mayer, Ltd.

[57] ABSTRACT

A control system for a multiple burner furnace has a programmable processor interfaced to hardware input and output circuitry associated with the furnace. The programmed processor provides a number of operating modules including a polling module, a startup module, a run module, and an alarm module. The processor and the associated hardware are interlocked in such a fashion that safe operation of the furnace is assured. For example, watchdog timers driven from the processor are interlocked with flame sensing hardware to control the main fuel valve and prevent fuel from flowing to the furnace in the event of either hardware or software malfunction. The safety features are equivalent to or better than a hardwired dedicated control system, while providing additional program-related flexibility and functionality.

17 Claims, 8 Drawing Sheets

MULTIPLE BURNER CONTROL SYSTEM

This application is a continuation-in-part of copending U.S. Ser. No. 08/203,170, filed Feb. 28, 1994.

FIELD OF THE INVENTION

This invention relates to industrial equipment such as furnaces which employ multiple gas- or oil-fired burners, and more particularly to electronic control systems for the burners with built-in safety features.

BACKGROUND OF THE INVENTION

There are numerous industrial processes which utilize gas- or oil-fired equipment such as furnaces, ovens, driers, boilers, heated baths, etc.; these will oftentimes be referred to herein by the term "furnace" intended to be generic to this class of heaters. This description will also refer specifically to gas-fired furnaces, because of their popularity. However, the invention is equally applicable to oil-fired equipment. Many of such furnaces employ multiple stage units requiring multiple burners. Oftentimes, they must be fired in a particular sequence. In almost all cases, they must be shut down for a flame failure malfunction in order to avoid the possibility of unwanted combustion or explosion. Control systems for these units can be complex or simple, but in most cases they have been special purpose systems which have little flexibility beyond the capabilities provided the system when it is installed and married with the furnace line.

It has been typical to utilize multiple burner controls which are of the hard-wired variety and dedicated to a specific furnace line. Part of the rationale driving that approach, it appears, is the fact that such systems are highly safety-related, and the production of single purpose devices avoids the availability of options and option switching which might impact the operating safety of the system. Thus, when a furnace line and its dedicated control system is installed, set up, tested and put into operation, it continues to monitor the assigned apparatus without intervention by an operator so that should a failure occur, it will be reliably reported, without the possibility of operator intervention having altered the system in a possibly detrimental way.

Flame sensor transducers which have been used in the past include both flame rod and ultraviolet type transducers. While each has its desirable characteristics, it is not uncommon to have systems where both types of transducers are used in the same furnace system. For example, flame rods may be used to monitor pilot flames, whereas ultraviolet transducers might be used for the main burners. The prior art has attempted to produce continuously variable or analog signals from the transducers which are indicative of the quality of the flame sensed by the transducer. Such analog signals have been brought to test points or have been brought to a selector switch so that an operator, using a voltmeter, can check the test points or manually select individual flames to read an analog voltage whose magnitude is indicative of the quality of the flame.

One of the significant events in connection with such control systems is a flame failure, and typically upon detection of a flame failure, the system is configured to go into an ordered shutdown. Prior art systems have been able to maintain a record of which flame failed and caused the shutdown, but insofar as applicants are aware, much of the information on the status of the system at the time of the failure is lost, because the status of the system clearly changes during the shutdown process. Thus, a maintenance technician may have information on which burner failed and the time of failure, but will likely have little additional information on the relationship of the failed burner to other areas of the system and their status at the time of the failure.

Due to their hardwired inflexibility, prior art control systems provided little opportunity to the operator to perform system functional tests by means other than the specific functions hardwired into the system. Thus, in order to test a particular feature, the operator would very likely have to run the system through its ordinary startup mode and simply take note of the characteristic of interest as the system automatically progressed through its hardwired inflexible startup sequence.

SUMMARY OF THE INVENTION

In view of the foregoing, it is a general aim of the present invention to provide a programmable control for a multiple burner system which has significantly more flexibility than prior art systems, while at the same time maintaining a degree of integrity needed to assure safe operation.

In accomplishing that aim, it is an object of the present invention to provide a system with multiple operating modes, but to program the system such that the mode which actually fires the burners cannot be entered unless and until the processor system assures that the appropriate options and components are in place.

It is an object to provide a system with enhanced troubleshooting ability, allowing an operator significant control over system sequencing in at least some operating modes.

In enhancing troubleshooting capabilities, it is a further object to maintain status information on all of the burners in the system, and to retain that information for analysis in the event a flame failure causes a system shutdown.

A further object according to the present invention is to provide a control system capable of using a standalone or system operable modular flame sensor, the flame sensor being capable of functioning with flame rod and/or ultraviolet flame transducers, such that the processor of the system controls all of the flame sensor modules in accordance with programmed operation. In that respect, it is a detailed object for the processor to assure that all expected flame sensors are in place and functional before commencing a burner firing sequence.

A general object of the present invention is to provide a control system for a multiple burner furnace, in which the control system has a plurality of programmed operating modes which can be individually invoked by an operator, but in which the modules which cause burner ignition are provided with sufficient safety checks to assure that the operator flexibility has not compromised system safety.

It is a feature of the invention that reliability equivalent to or better than prior hard wired system is provided while at the same time providing the adaptability and flexibility of a microcomputer based system. Thus, at the manufacturing level, the producer of the control system has the opportunity to change system characteristics by software alterations, making the hardware relatively universal. At the installation level, internal switches and jumpers can be set to adapt the system to a particular furnace installation. The system preferably operates with standalone flame sensors which have a high degree of reliability and certain failsafe features. The processor is connected to the flame sensors and is capable of cycling the flame sensors to test their operability before attempting to fire the furnace. Finally, the control system itself has a number of software and hardware reliability features built in, such that the software and hardware tend to test each other. A final feature provides for lockout of burner ignition in the event a hardware malfunction is detected, no matter what the software is doing. Thus, even in the event the software completely loses its sanity, a hardware fault will be detected and will cause a lockout which cannot be overridden by the software under any conditions.

Other objects and advantages will become apparent from the following detailed description when taken in conjunction with the drawings, in which:

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
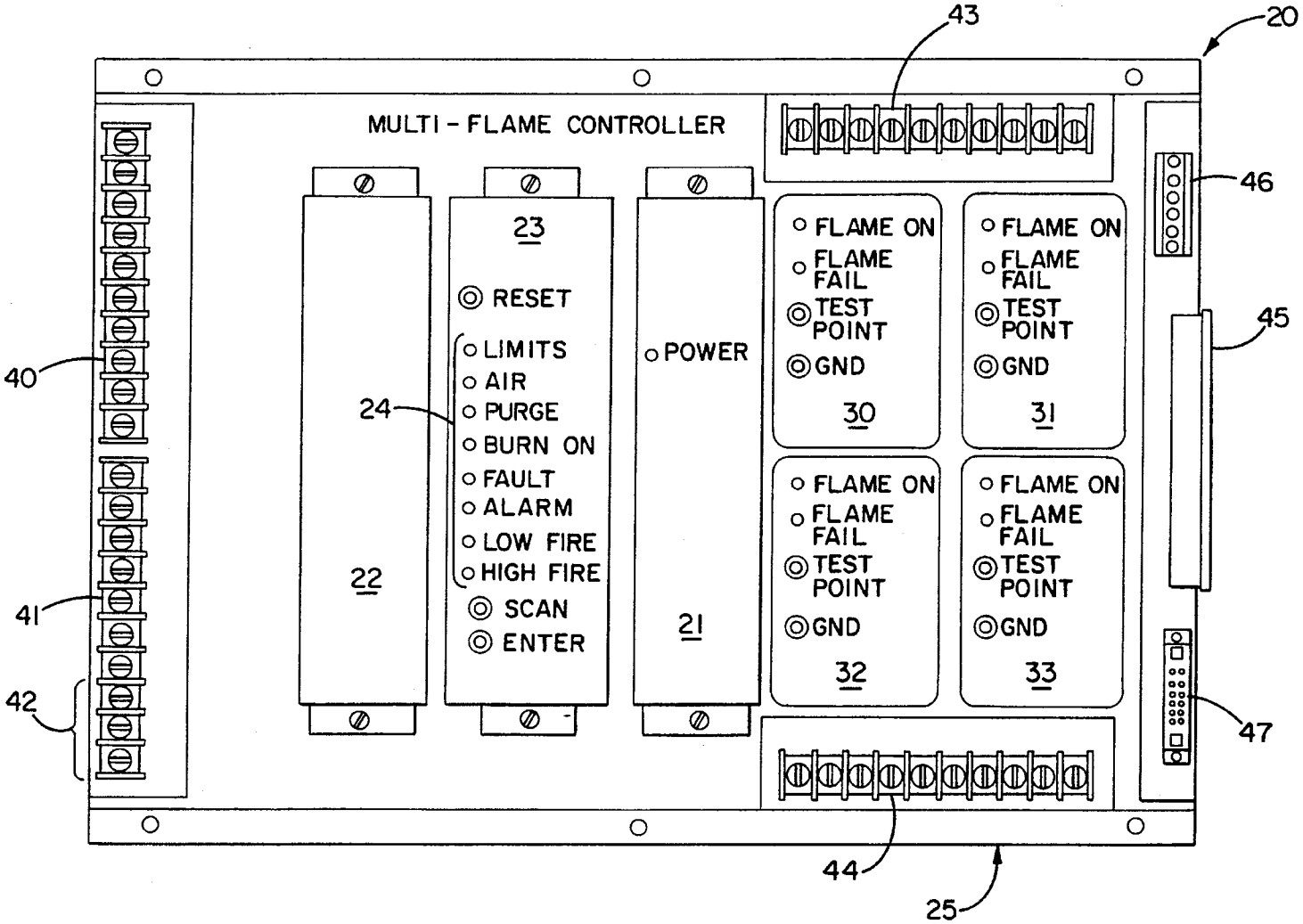
FIG. 1 is a diagram showing the hardware configuration of a controller constructed in accordance with the present invention.

Turning now to the drawings, FIG. 1 gives an overview of the hardware of the system and, at a first level, an indication of its universality. A system such as is illustrated in FIG. 1 can serve numerous kinds of heating applications including furnaces, dryers, zone controlled heaters, fluid baths with multiple burners, to name a few. The system can be set with different sequences of firing, different purge time characteristics, different safety features, but in any event the basic component shown in FIG. 1 will remain the same. For larger systems, additional burners can be handled by simply connecting additional flame sensor modules to replicate the modules located at the right of FIG. 1.

The system of FIG. 1 includes a basic control unit 20 made up of a number of standardized modules. A power supply module 21 derives AC power from an external source and provides power at the appropriate levels for the remainder of the electronic elements. A relay module 22 provides output control for the elements of the furnace system, and a degree of sensing of those elements. The main logic of the system is contained in a microcomputer based logic module 23. An array of indicator lights 24 provides a visual display of the status of the system. Three operator accessible switches adjacent the array 24 allow operator control during certain modes of operation.

The control system panel 20 includes a section 25 which is provided for continuous flame monitoring of the individual burners in the system. The section 25 provides space for insertion of flame relays, one per burner. The unit 20 is shown as having four flame relays 30–33. The relays are preferably of the type described in Wild U.S. application Ser. No. 203,170 assigned to the same assignee as the present invention. They provide a degree of failsafe operation, and include a number of external connection points which are accessible to the processor in the chassis 20 in order to provide the overall system with the desired degree of failsafe operation.

Conventional industrial-type terminal strips provide for interconnection of the unit 20 with the external equipment of the furnace line. A first terminal strip 40 provides for connections to high power inputs, such as 120 volt inputs from switches and interlocks in the furnace line. A second terminal strip 41 provides for output connections to the high power equipment such as fan motors, gas valves, pilot generators and the like. A portion 42 of the terminal strip 41 is reserved for modulation connections to associated equipment. The flame relay modules 30–33 also have terminal strips associated with them. A terminal strip 43 is provided for connections to the flame relays 30 and 31. It provides connections for either a flame rod or an ultraviolet sensor or, in the case where an associated burner has both, both such transducers. A similar terminal strip 44 is provided for connections to the flame relays 32, 33.

A connector 46 is provided for communication capability, and allows the connection of an interface cable adapted to communicate with communication interfaces such as an RS232 interface and an RS485 interface. A further connector 47 is provided for the connection of an external visual display, such as an LCD display. The display is driven by the processor in the logic module 23 via connections made via connector 47, to indicate the status and operation of the system. Such a unit is particularly useful when an operator is adjusting or troubleshooting the equipment.

A further plug-in connector 45 is provided for connection with a similar mating connector on an expansion module which carries an additional four flame relays. The connector 45 and its mating connector on an expansion module (not shown) provide the necessary electrical connections for analog and digital flame buses, and a selector bus. AC power connections are also provided on the expansion chassis. Similarly, the expansion chassis will have a further connector for accommodating a further expansion chassis. In a preferred embodiment of the invention, the controller chassis 20 is capable of controlling four burners on the main chassis 20, and additional 4-unit modules up to a total of 24 flame relays. Thus, the control system is able to accommodate a furnace line having as many as 24 burners and has adequate capacity to control, sense and monitor the condition of operation of all of those burners.

The main modules of the system 21–23 are also of the plug-in variety. Each of the modules 21–23 is based on a printed circuit card with a standard form of pinout structure at the base thereof which fits into card edge connectors mounted in and wired into the chassis. Similarly, the flame relays 30–33 are removable units which are inserted into standard industrial eleven-pin relay plugs. It will thus be appreciated that the unit has a high degree of serviceability and that any of the modules can be removed for testing or replacement. In addition, the flame relay modules can be interchanged one with the other, or replaced by new units when one is found to be defective. Even in the presence of this plug-in interchangeability, safety features of the unit assure that all of the units are in place and match the requirements of the furnace line before a burner ignition sequence is commenced.

Figure 2:
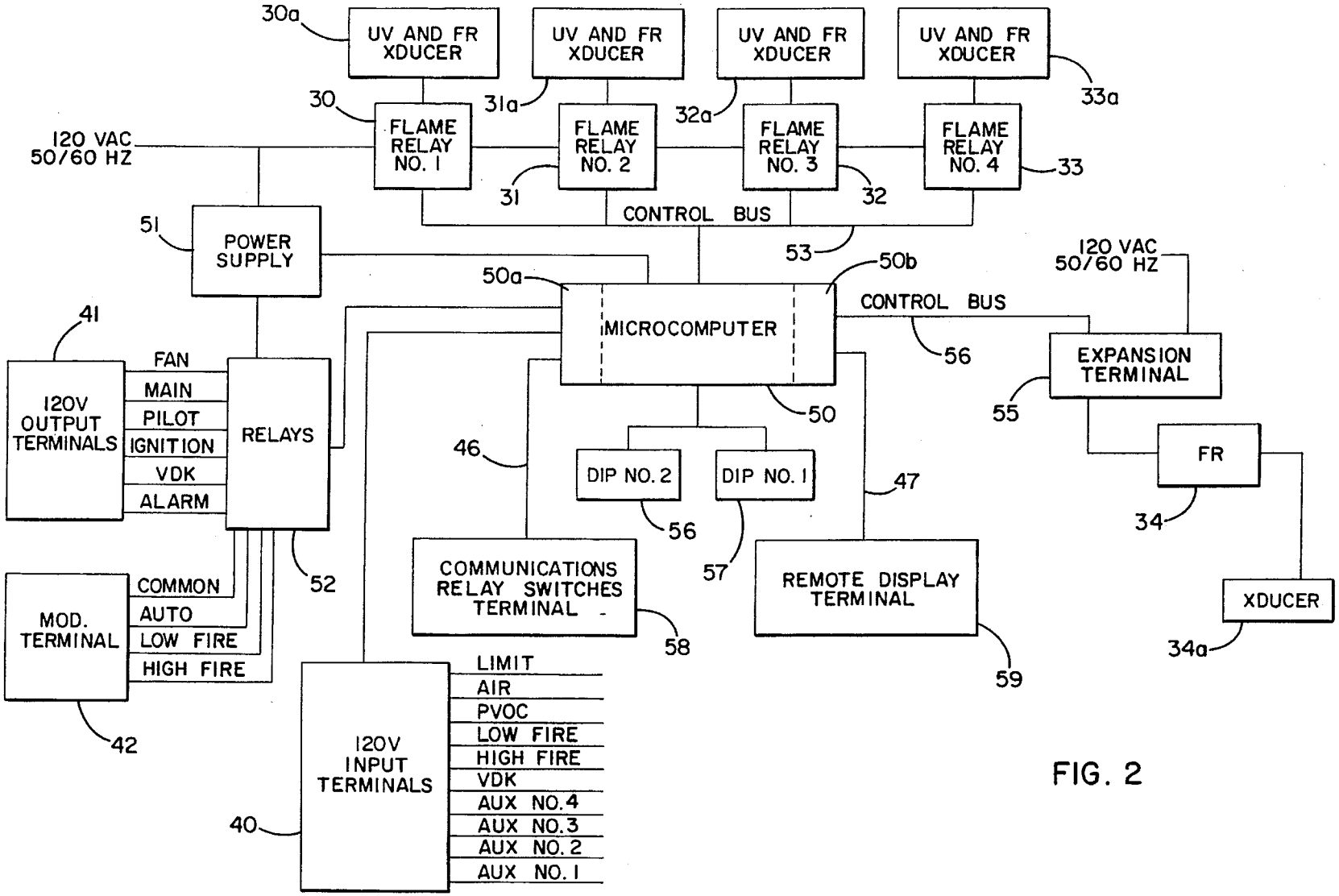
FIG. 2 is a block diagram of the electrical and electronic components of the system of FIG. 1.

FIG. 2 is a block diagram illustrating the primary electrical components of the system of FIG. 1. Central to the system is a microcomputer 50 which is the primary control element of the logic module 23 (FIG. 1). A power supply 51 (the primary element of power supply module 21) is connected to the microcomputer and other electronic elements to supply the needed operating voltages. An array of relays 52 resident on the relay module 22 (FIG. 1) provides, via the output terminal block 41, signals for operating the control elements of the furnace line. The modulation terminal block 42 is also shown as being connected to the relay array 52. The input terminal block 40 is connected to lines which bring sensed signals in from the furnace line, for processing by the microcomputer 50. The microcomputer 50 has a memory associated therewith. In the illustrated implementation, the memory 50*a* is an element of the microcomputer itself. The program is stored in a non-volatile section of memory 50*a* and provides a sequence of steps which drive the microcomputer in the various modes to be described below. The memory 50*a* also includes a section of RAM 50*b* which serves as operating memory and also as an updatable status memory. The status memory retains information on system status for readout and analysis in the event of a flame failure.

Information on the presence and quality of the flames in the furnace is derived through the flame relay modules 30–33. Each flame relay is connected to a flame transducer 30*a*–33*a*. As noted above, the flame transducer can be either an ultraviolet transducer or a flame rod transducer, or both. A control bus 53 connects the flame relays 30–33 to the microcomputer 53. As will be described in greater detail, the control bus includes digital flame signals, analog flame quality signals, both passed to the microcomputer for analysis, and a module test or control bus which is driven by the microcomputer to sequentially or selectively exercise the flame relays to test their operability. FIG. 2 also illustrates an expansion terminal 55 also connected to the microcomputer 50 by way of a control bus 56, and to a source of external AC power. The expansion terminal 55 provides for additional flame relay modules 34 and associated transducers 34*a*, only one of which is illustrated in the diagram.

Also associated with the microcomputer are elements which allow the overall system to be configured to match the characteristics of a particular furnace line. In the illustrated embodiment, such elements are illustrated as a pair of DIP switches 56, 57. One of the DIP switches, as will be described in greater detail below, allows the installer to specify the number of flame relay modules which will be used in a particular installation. Whenever the system is started up, the microcomputer 50 will examine the number of expected flame relay modules by way of DIP switch 56, and compare it to the number of flame relay modules actually in position (as sensed on control bus 53), and will allow sequencing of the system to continue only when the numbers match. The second set of DIP switches 57 is provided for other system selected options, such as purge time, sequencing variations, and other variables.

A communications module 58 provides the opportunity for the microcomputer 50 to communicate with remote terminals or remote displays. In a preferred embodiment, both an RS232 and an RS485 interface are provided in the module 58 to allow for a broad range of communication with standard computer terminals. The communications can allow for downloading of status information, updating of software information, and other features. Finally, a remote display terminal 59 is connected to be driven by the microcomputer 50 to provide to a user a display of status information in the computer under the control of the operator.

Attention will now be focused on the structure of the flame relay modules and their interconnection to the control system. The circuitry of a preferred flame relay module will then be described, following which the description will proceed to the circuitry of the other modules of the control system.

Figure 3:
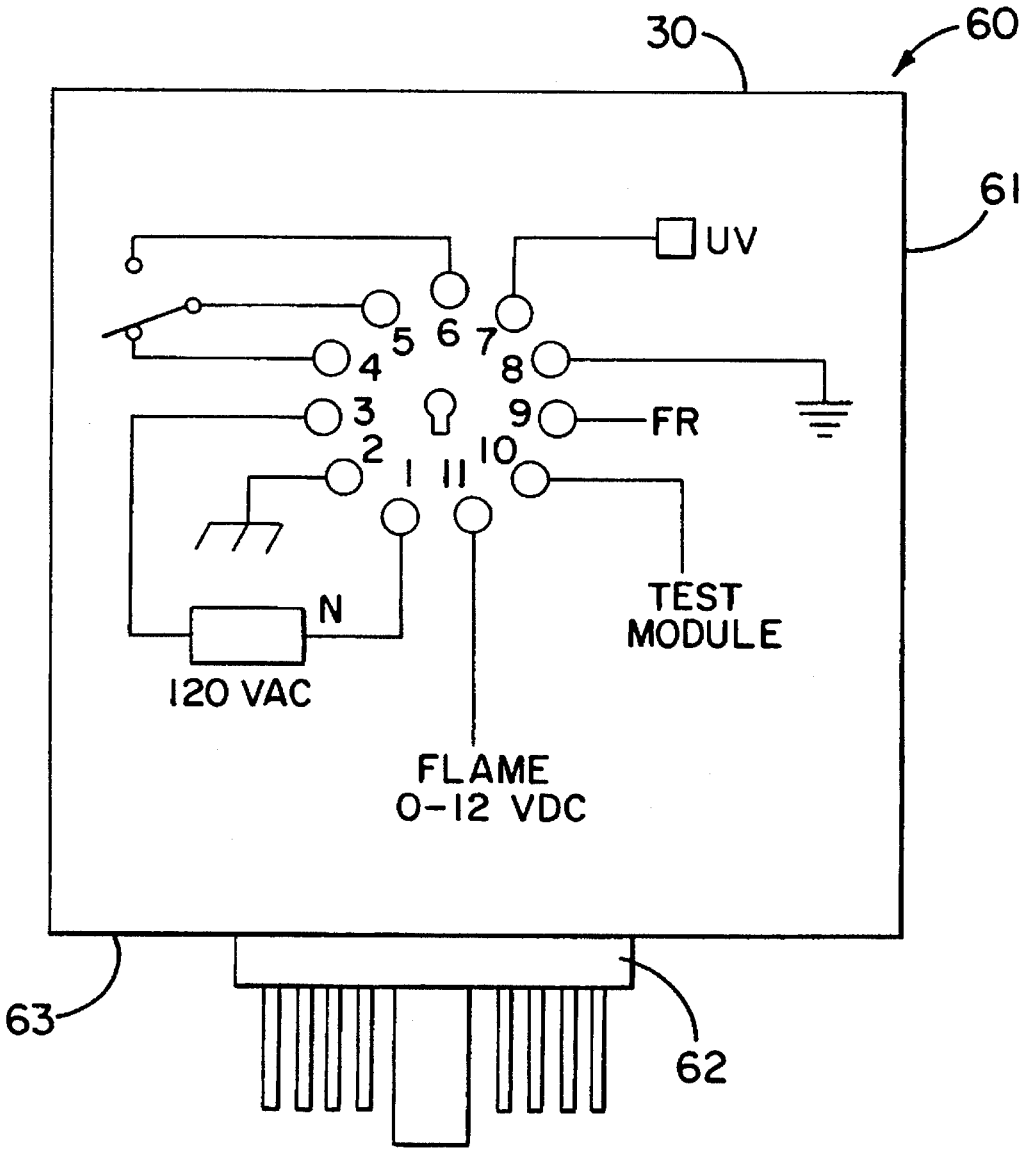
FIG. 3 is a view of one side of a flame relay module and includes a diagram of its electrical connections.

FIG. 3 illustrates in elevation a single flame relay 60 as it appears when removed from the control module 20. The modular relay 60 is packaged much like an industrial relay and includes a generally rectangular enclosure 61 having a standard 11 pin relay plug 62 affixed to a mounting surface 63. The plug 62 provides for interconnections with an external power supply and also with the control system. For convenience, there is reproduced on one of the faces of the module a schematic illustration of the plug and its connections. It will be seen that pins 1, 2 and 3 are provided for connection to a standard 120 volt AC source with earth ground. Pins 4, 5 and 6 are provided for the switched connections operated by the internal relay of the module. A digital flame bus for all of the modules in the system has a wire connected to pin 6 of each of the flame relay modules.

Pins 7, 8 and 9 are provided for connection to the flame sensor transducers. When an ultraviolet transducer is used, it is connected between pins 7 and 8. When a flame rod transducer is used, it is connected to pin 9, with the case of the flame rod being grounded where installed.

Pin 10 of the flame relay module provides a connection for a test signal coupled to the module by the control system. As will be described in greater detail below, a signal coupled to pin 10 allows the central processor to simulate the presence of a flame and to test the operation of the relay in the presence of that simulated flame.

Finally, pin 11 of the module provides for a DC output from the module having a level which is relate to the quality of the flame sensed by the transducer connected to the module. An analog flame bus is connected to pin 11 of each module in a control system, and as will be described below, the analog signals on those lines are digitized for analysis by the processor to determine the quality of the flame sensed by each module. In a standalone mode, the signal on pin 11 is also brought out to a test point on the top of the flame relay module for local access by a technician.

Figure 4:
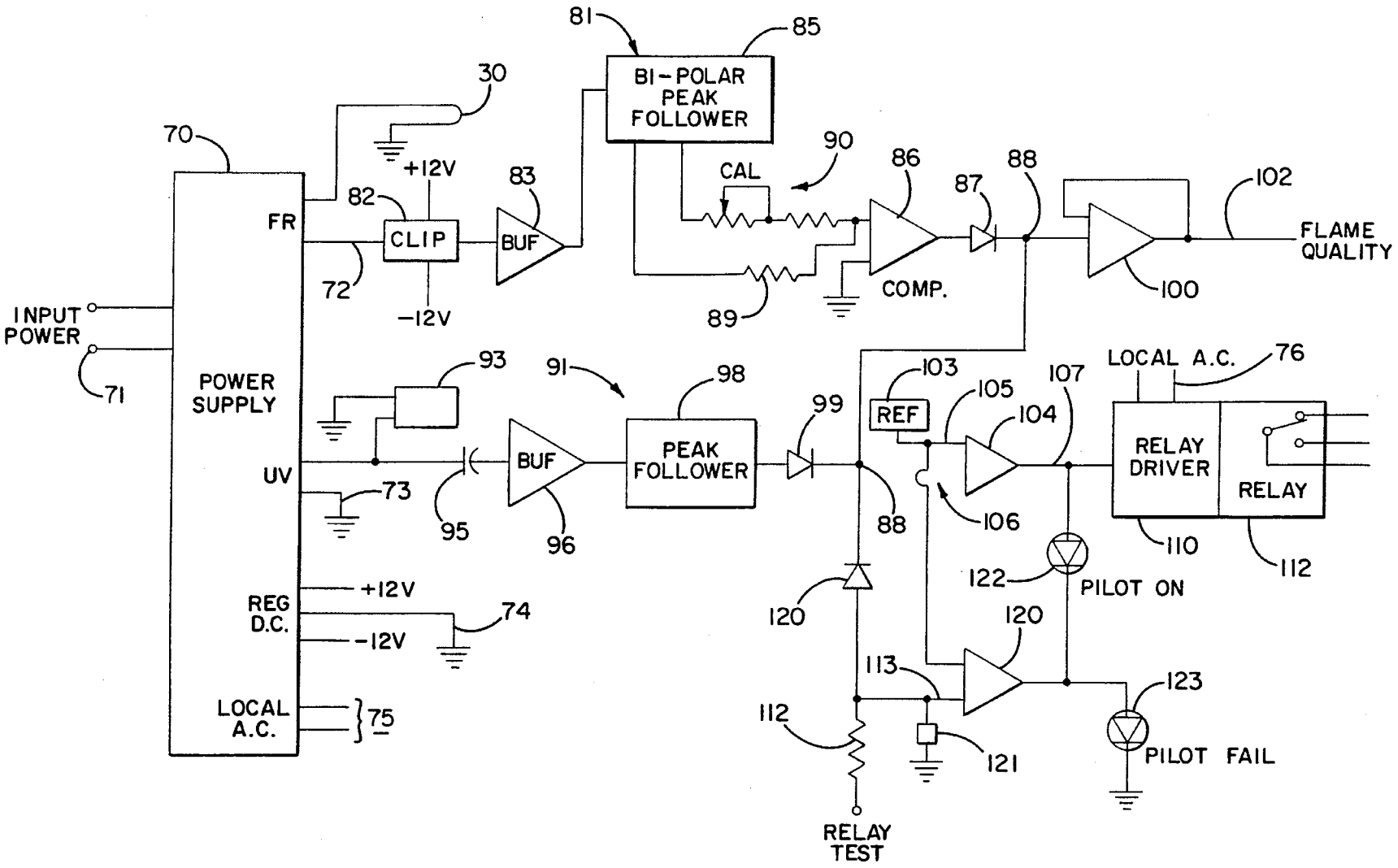
FIG. 4 is a block diagram showing a flame sensor module and its interconnection to the control system of FIG. 2.

Turning to FIG. 4, there is shown a high level schematic diagram illustrating the circuitry of a flame relay useful in the practice of the invention. A multifunction power supply 70 is provided having provision for connection to an AC input supply 71, labeled "input power" in the drawings. The input power would be connected to pins 1–3 of the relay socket. The power supply provides a relatively high voltage AC supply 72 for the flame rod, a relatively high voltage DC supply 73 for the ultraviolet transducer, a relatively low voltage regulated DC supply 74 for the electronic elements, and a local AC supply 75. The regulated DC supply in the illustrated embodiment is a bipolar supply providing regulated outputs of +12 and −12 volts for operational amplifiers utilized in the interface and sensing circuitry. The local AC supply 75 is utilized to drive the relay which switches the output contacts.

A flame rod 80 is shown schematically as being connected between the flame rod power supply 72 and ground. The flame rod power supply 72 produces a relatively high voltage AC signal. It is preferred, for example, to use an AC signal on the order of 200 to 400 volts. If a pair of secondaries in a 1:1 isolation transformer are coupled in series, an AC signal of about 350 volts peak will be produced for the power supply 72.

The flame rod 80 has the characteristic that in the absence of a flame it is substantially an open circuit, and the AC signal applied to it is substantially unaffected. In the presence of a flame, however, the flame rod 80 begins to act as a rectifier, and the positive peaks of the AC signal will decrease in magnitude, whereas the negative peaks will increase in magnitude. The flame rod interface circuitry 71 processes the flame rod signal to produce an internal signal having a magnitude of particular characteristics to be described in greater detail below. The AC signal produced by the power supply 72 is passed through a clipper 82 which limits peak excursions to positive or negative 12 volts, and thence through a buffer amplifier 83 associated with a bipolar peak follower 85. The bipolar peak follower 85 includes a pair of capacitors, one being charged to the peak positive voltage, and the other to the peak negative voltage. The time constants are such that the charge on the capacitors will change as the magnitudes of the peaks change, but the signal level will integrate from peak to peak to be relatively constant over that short interval. In effect, the circuit arrangement described thus far produces signals having levels which relate to the magnitude of the positive and the magnitude of the negative peak. Those signals are compared in a comparator 86. In the absence of a flame, the comparator 86 senses slightly more positive than negative magnitudes for the positive and negative peaks, and produces an output near ground. As the flame intensity increases, the signal relating to the positive peak gets smaller, whereas the signal related to the negative peak gets larger, causing the output of the comparator 86 to produce an increasingly positive output. That output is passed through a diode 87 to a summing junction 88. It will be noted that the circuitry coupling the bipolar peak follower 85 to the comparator 86 includes scaling resistors 89, 90, and that scaling resistor 90 is adjustable to achieve a DC level at a summing junction 88 which is calibrated to the magnitude of the flame. That level is adjusted to produce a DC signal at the junction 88 which is calibrated in magnitude to flame quality and of the same magnitude as the positive signal produced by the ultraviolet interface circuits for a comparable flame.

The ultraviolet transducer is illustrated diagrammatically at 93, and is shown connected between ground and one terminal of the ultraviolet power supply 73. The ultraviolet power supply is preferably a relatively high voltage DC supply, desirably on the order of about 425 volts DC. In order to achieve a power supply of that magnitude in the confined space of the module, a voltage tripler is employed and is driven from the same transformer which powers the other supplies. The ultraviolet transducer 98 is aimed at the flame, and the flicker of the flame causes a ripple in the signal imposed on the DC supply by the ultraviolet scanner.

Ultraviolet sensor interface circuitry 91 processes the signal to produce an internal signal similar to the signal produced by the flame rod interface circuitry 81. The varying signal resulting from the flickering flame is passed through a capacitor 95 to a buffer amplifier 96 associated with a peak follower 98. The peak follower tracks the maximum excursion in one direction (for example, the positive excursions) of the varying AC signal coupled through the buffer amplifier. A relatively higher level signal stored in the peak follower 98 is an indication of a relatively high level of flicker of the flame, and thus of a relatively good quality flame. The DC signal which is stored in the peak follower 98 is passed through a diode 69 to the summing junction 88. As noted above, the systems are calibrated, such as by means of calibrating control 90, to cause the production of a voltage at node 88 having a magnitude which is calibrated to a known good flame, such that the voltage at point 88 is representative of the quality of the flame no matter whether a flame rod or ultraviolet transducer is utilized.

It is noteworthy that the diodes 87, 99, and their coupling to the subsequent comparators causes the junction 88 to serve as a summing junction. In effect, the respective interface means 81, 91 produce positive signals connected through appropriate poled diodes to the summing junction 88. The interface circuitry is constructed such that the absence of the associated flame sensing transducer produces a signal equivalent to a "no flame" signal. Thus, when the module is used in the typical system, there will be on active interface and one inactive interface coupled to the summing junction. The active or inactive interfaces are selected only by virtue of the fact that they have a transducer coupled to them. The voltage level at the summing junction causes the remainder of the circuitry to operate identically irrespective of the type of transducer, or the identity of the active interface. In the case where both types of transducers are connected to the same module, the summing junction will indicate the flame quality resulting from one or both transducers.

The voltage produced at the summing junction 88 is utilized both to control bi-state status indicators on the module and also to produce an analog signal having a magnitude representative of the quality of the flame, coupled on an analog flame bus back to the control circuitry for analysis by the microprocessor.

An amplifier 100 has an input coupled to the node 88, and is connected as a unity gain amplifier, to produce an output signal at a junction 102 which is an analog signal representative of flame quality. As noted above, that level is typically about 5 volts at the threshold of a good flame, correspondingly higher for flames of increasing quality, and lower for flames of questionable or inferior quality.

The voltage at junction 88 is also coupled to a comparator 104 having a first input 105 coupled to a reference voltage source 103, and a second input 106 coupled to the junction 88. The reference voltage 103 is set to establish a desired threshold, for example, at 1.6 volts, or 2 volts such that whenever the voltage at junction 88 is higher than that threshold, the output 107 of the comparator 104 will be at a high level. Whenever the voltage is below the threshold, the output 107 will be near ground. When the output 107 is high, the output activates a relay driver 110 which in turn energizes the output relay 112. The relay driver 110 is connected to the local AC supply 75 to utilize the local AC power for operation of the relay. The signal provided by the output 107 serves as a triggering voltage, typically for a triac in the relay driver 110, which serves to maintain the relay energized whenever the interface circuitry 81, 91 determines that a flame is sensed at a level above the threshold. Thus, the relay 112 in the flame-on condition will have the relay contacts switched to the state opposite that shown in FIG. 4, with the normally open contacts closed and the normally closed contacts open.

With the interface circuitry 81, 91 sensing a good flame, the flame-on indicator 122 will also be energized. The high level produced at the output 107 of the comparator 104, coupled with a low output signal produced by a comparator 110 will forward bias a green flame-on light-emitting diode 122. If the flame extinguishes, the voltage at the summing junction 88 falls below the reference level, and the module responds by deenergizing indicator 122 and dropping out relay 112, returning the relay contacts to the state illustrated in FIG. 4. In the case where a module has two transducers connected simultaneously, the comparator 104 will maintain the high output (flame-on indicator growing) until both transducers detect the no-flame condition.

The comparator 110 compares the same reference voltage 103, with a DC level coupled from a relay test input 113 connected to input 113 of the comparator. Typically, the pin 112 is held near ground by the processor, such that the reference voltage 103 will be higher than the voltage on input 113, causing the output of the comparator 110 to be low. That provides a ground return for current flow through the flame-on indicator 122 so that the indicator will be illuminated whenever the comparator 104 detects a flame signal above its threshold.

When it is desired to test the functionality of the system, the logic module imposes a test signal on pin 10 of the relay plug. The signal can be AC or DC, and at any level in the range from 12 to 120 volts. That test signal, in effect, simulates a flame present signal produced by the transducer. It is coupled through a forward-biased diode 120 to the junction 88. A clamp 121 clamps excursions of the signal at the anode of the diode 120 to about 5 volts. Considering that the same reference voltage 103 is applied to the reference inputs of both comparators 104 and 110, and considering that the diode drop provided by forward biased diode 120 renders the signal applied to the sensing input of comparator 110 higher than the signal applied to the sensing input of comparator 104, the flame-on indicator 122 will be reverse biased. The fact that the output of comparator 110 has swung positively will also forward-bias a red flame-fail indicator 123, causing it to illuminate. Realizing that the test signal will usually be applied when the furnace is off, prior to application of the test signal the relay 110 will be de-energized by virtue of the lack of a positive signal at the junction 88. Upon application of the test voltage by the logic module, the rise in voltage at the junction 88 will also activate the relay, allowing the logic module to monitor the relay contacts (via digital bus coupled to the contacts of relay 112), to monitor the relay contacts for proper functionality. This aspect of the test is useful both for testing that an operable module is in place where expected, and also for assuring that relay contacts are functional and are not welded.

In summary, in the preferred practice of the invention, the flame relay module performs a number of functions autonomously. It adapts itself to whichever type of flame transducer is utilized, and produces both a digital signal indicating the presence or absence of a flame, and an analog signal indicating the quality of the flame. Those signals are coupled to respective digital and analog flame buses for analysis by the logic module. In addition, a test bus is provided connected to the test point of each flame relay module, and that can be cycled by the logic module as needed (while monitoring the analog or digital outputs) to assure the presence and functionality of the flame relay module.

Thus, the flame in the burner associated with a particular flame relay is continuously monitored by the flame relay module acting on its own, but in turn the processor that controls the logic module monitors each of the flame relays (and cycles them under test as needed) to monitor the status of the flame relay, and also the presence and quality of the flame sensed by each relay.

Before describing the control system in detail, a number of features will first be highlighted. The system is microcomputer controlled and thus processes digital inputs and produces digital outputs. Digital signals thus control the output, but do so via higher power circuit elements capable of switching operating power, such as 120 volts AC. Interlocks in the output are responsive to several features of the control system, including the software which runs the microcomputer, digital gating and logic circuitry which controls the digital circuits, and actual interlocking of AC power switched to the outputs. The multiply redundant aspects of that type of safety circuitry assure to the greatest extent possible that the controlled equipment is operating in a safe manner.

Similarly, at the input the flames themselves are sensed by conventional sensors using relatively high power circuitry as is normal. In addition the flame relays produce both digital and analog indications of the presence and quality of the flame. Both of those types of signals are sensed by the microcomputer and analyzed by the controlling software to assure that the system is operating properly.

Watchdog timers are utilized with the microcomputer to assure that the software has maintained its sanity. The watchdog timers, in accordance with the present invention, are interlocked directly with flame signals, such that if the software loses its sanity, no matter how seriously that sanity is lost, if a flame signal is absent, the watchdog timer will assure that the gas valves are turned off to prevent a disastrous accident. There are other such features and interrelationships between the various parts of the control system which will become more apparent as the description progresses, and this brief introduction was intended simply to highlight some of them.

Figure 5:
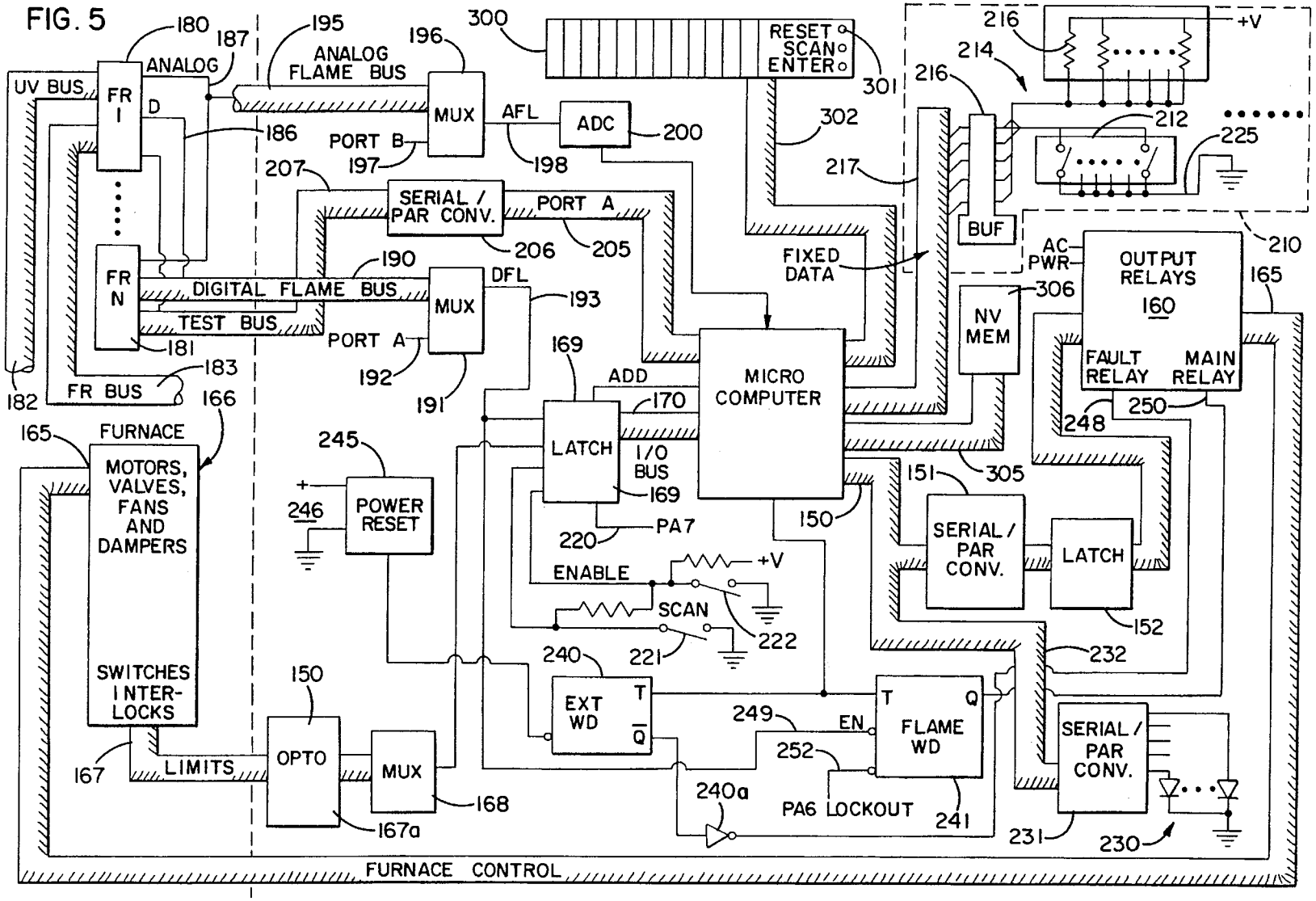
FIG. 5 is a diagram showing the electrical and electronic components of the system of FIG. 2 and other functional interrelation.

Turning then to FIG. 5, there is shown a simplified block diagram of the control system of the present invention associated with a furnace system. A number of liberties were taken in illustrating the system so as to aid in understanding of the invention. For example, the microcomputer is shown with certain buses connected to certain equipment, with the buses being functionally identified. In an actual hardware implementation, the microcomputer is a commercially available Motorola part MC68HC705C8CP. As will be known to those skilled in this art, that microcomputer has four 8-bit input/output ports (PA-PD) and a number of control lines. In the implementation used in a preferred embodiment of the present invention, port A is used primarily for output data, port B is used primarily for addressing and for the remote display, port C is used primarily for control and strobe signals, and port D is also used for control signals. The nature of those ports does not appear directly in FIG. 5; instead, the ports are shown functionally as related to input or output structure, which is a more understandable way of appreciating the structure and operation of the present invention. Similarly, the multiplexers, converters and the like are shown with control connections functionally linked to the microcomputer and other elements, without showing the details of all of the gating which would ultimately be used for a complete commercial product. As will be appreciated by those skilled in this art, that simplification is introduced primarily to focus on the inventive aspects of the present invention, with the hardware details being within the understanding of one skilled in the art when armed with an understanding of the present invention.

Turning to FIG. 5, it will be seen that the microcomputer 50 is located near the center of the diagram and has a number of input and output buses connected thereto. For purposes of controlling the furnace line, an output bus 150 is connected through a serial-to-parallel converter 151 to a set of latches 152. The outputs of the latches 152 in turn are connected to an output relay module 160. The output relay module 160 (which will be described in greater detail in connection with FIG. 6) includes an interconnected series of relays, driven by the microcomputer 150 through the output bus 150, having AC power from a source 155 connected thereto, and interlocked to provide power signals on an output bus 165 which drive the valves, fans and other equipment of the furnace. The bus 165 is shown as being connected to the furnace which is schematically illustrated at 166. While the details of the furnace are not illustrated, the notations indicate that the furnace may contain motors, valves, fans and dampers all of which are driven by power signals on the bus 165. Interlocks and other safety switches on the furnace provide signals which are taken out of the furnace on a bus 167 and passed through optoisolators 167*a*, a multiplexer 168 and a latch 169 for input to the microcomputer 150 on an input/output bus 170. Thus, the state of the furnace (in part) will be determined by the interlocks and switches which are installed in the furnace. High power signals on the bus 167, are converted to logic signals in an optoisolator module 167*a*, passed as logic signals through a multiplexer 168, latched under the control of the microcomputer into a set of latches 169, and read when desired by the microcomputer 50 using the bus 170.

As noted previously, feedback signals with respect to the presence and quality of the flame are provided by a series of flame relays, one per burner. In the illustrated embodiment, two such flame relays 180, 181 are illustrated, representing flame relays 1 and n. A number of additional flame relays between 1 and n will be included in the system between the modules 180 and 181. It will be seen that a UV transducer bus 182 is provided and a separate flame rod transducer bus 183. If a flame relay module 180 is configured with an ultraviolet transducer, a connection will be made between that flame relay module and the ultraviolet transducer bus 182. Similarly, when the flame relay is associated with a burner which includes a flame rod, a connection from the flame rod to the relay module will be made via the flame rod bus 183. Each flame relay, in addition to AC power inputs (not shown in FIG. 5) includes a control input 185 and a pair of outputs 186, 187. Focusing on the output 186 first, that is the digital output. In most installations, the output 186 will be switched to ground when the flame relay is operated. Typically, the output line 186 is the normally open contact of the output relay, and that contact, upon actuation of the relay, will be switched to ground, to which the common of the contact set is connected. The contacts 186 from all of the flame relays are connected to a multi-conductor digital flame bus 190. That bus in turn is connected to a multiplexer 191 which is controlled via the processor and a series of select inputs 192 to sequentially switch the inputs on the digital flame bus 190 to a single output 193. Thus, the output 193 will be at a logic level which matches the logic level of the selected flame relay, and as the control inputs 192 cycle through all of the flame relays, the output 193 will switch to the input associated with each sequential flame relay. When all of the flame relays are activated by associated flames, all of the signals on the digital flame bus 190 will be at a low level, and as the processor sequences the selector inputs 192, the output 193 will remain at a logic low level. If during the sequencing one of the flame relay outputs goes high, that is a signal to the processor that the flame relay in question has a flame failure, and the processor will take appropriate action. The single line output 193 labeled DFL serves as an input to the latch 169, so that when the processor 50 reads the latch by appropriate addressing thereof, the appropriate bit in the I/O bus 170 will be read as an indication of the state of the flame relay being addressed at that point in the sequence.

The input terminals 192, 197 of the multiplexers 191, 196 are driven from the microcomputer 50. While a connection is not directly shown in the diagram of FIG. 5, the diagram does illustrate that the control is via port A of the microcomputer. Thus, the microcomputer 50, during the course of its sequencing, controls the digital outputs of the I/O bus on port A with appropriate signals needed to control the selector inputs of the multiplexers 191, 196. Similarly, the selector port 208 of the serial-to-parallel converter 206 is controlled by port A of the microcomputer.

Returning to the flame relays themselves, the outputs 187 are combined in a multi-conductor analog flame bus 195 which is passed to a multiplexer 196. The multiplexer 196 is an analog multiplexer operated under a series of control inputs from the processor applied to the multiplexer on input 197. The output of the multiplexer on a line 198, identified as AFL (analog flame) is passed to an analog-to-digital converter 200. The analog-to-digital converter operates in conjunction with the microcomputer 50 to cause each successive analog flame signal selected from the bus 195 by the multiplexer 196 to be digitized and passed to the microcomputer. Thus, the microcomputer 50 will acquire a sequence of digital words representative of the flame quality output of the flame relays. Thus, through the circuitry just described, the microcomputer 50 is able to obtain analog information from the flame relay modules, select that information via the multiplexer 196 and digitize that information via ADC 200 to provide the microcomputer 50 with a sequence of digital words representative of the quality of each flame in the system.

For purposes of testing the flame relay modules, the microcomputer, via an output bus 205 connected to a serial-to-parallel converter 206, drives a selector bus 207 coupled to individual inputs 185 of the respective flame relays 180–181. There is a signal line for each flame relay in the bus 207, and that signal line will be driven to an active level whenever the flame relay is to be tested.

In the exemplary embodiment, when it is desired to test the flame relay, the line in the test bus 207 associated with that flame relay is brought to an intermediate level (such as 5 volts), which in the illustrated embodiment is indicative of an acceptable flame level. That signal level, simulating a flame of acceptable quality, is then imposed on the flame relay test input, and the output contacts monitored (via the digital flame bus 190) to determine operability of the system. Thus, the microprocessor acting through the output bus 205 and the serial-to-parallel converter 206 is capable of individually testing each flame relay module. Signals imposed on the output bus simulate a flame, and the signals input on the flame bus determines the action of each flame relay in response to that simulated flame, thereby to assure that each module is operational. As will be described below, a test of all flame relay modules is made before a burner firing sequence is entered, in order to assure that all flame relays are both present and operational before the main gas valve can be opened.

In accordance with one significant feature of the invention, manual selector means 210 are provided for tailoring certain inputs of the microcomputer to the characteristics of the furnace system to which it is connected. In the block diagram of FIG. 2, the selector means were shown as DIP switches 56, 57. In FIG. 5, the selector module 210 is illustrated with a single selector switch 212 and its associated components. It will be apparent that a number of selector switches will normally be provided, and will be connected like the selector switch 212. It will also be clear that other forms of jumpers or interconnecting devices can also be used. The selector switch approach, however, is preferred.

The illustrated selector switch 212 is a dual inline package selector switch (DIP switch), preferably including 8 individual switch elements. An 8-line bus 214 is connected to individual contacts of the switches 212, and the other contact of each switch is connected to a circuit common 215. A module of pull-up resistors 216 is connected between each line of the bus 214 and the positive supply. Thus, when a switch is closed, the appropriate line of the bus 214 will be at a low level. Similarly, when an individual switch is open, the pullup resistor will bring that line of the bus to a logic high. The bus 214 is connected through a series of tristate gates 216 to an input bus 217 of the microcomputer 50. As indicated in the drawings, the input bus 217 is connected to port B in the preferred embodiment. The tristate gates 216 are gated by a signal from the computer, illustrated as arising from port A. A plurality of switches, three in the preferred embodiment, are similarly connected, each being gated by a different signal, so that port B can be used to read in information from a plurality of fixed switches.

In practicing an important aspect of the invention, at least one of the switches 212 is used to fixedly program in a number corresponding to the number of flame relays in the particular installation for the control system. Thus, if the system has 9 burners, the switch 212 would be set to an output on bus 214 corresponding to the number 9. Prior to invoking startup module, a polling module is invoked in which the microcomputer 50 is caused to read the information on bus 217. When it reads the word corresponding to the number of flame relays in the system, it has that information for the system in question. Under the polling module, the microcomputer 50 also cycles through all of the flame relays 180–181 to test for their presence and operability. The number of flame relays which test positive is compared to the number of relays set by the switch 212. Only when the numbers match is the microcomputer 50 allowed to proceed in the startup module. Thus, if for example a flame relay is removed from its socket, the microcomputer 50 in its test of the flame relay modules will find one less than the expected number of operable flame relays, and when that number is matched to the number set in switch 212, a mismatch will occur, and the microcomputer will cause the system to go into lockout.

In addition to programming this important safety function, additional switches 212 are used for system selectable fixed options. For example, different purge times can be associated with the high fire and low fire sequence, and those are set using the fixed switches. The pilot can be left on in some systems or turned off after the main burner is fired, and that option can be selected using the fixed switches. Other similar options characteristic to particular furnace lines are also selectable in this way.

The ability of the microcomputer 50 to read the fixed data on bus 217 thereby allows the system to be customized. The fact that the switches 212 are installed in a reasonably inaccessible location, such as right on the logic card itself, makes it very difficult for the average user to alter the switches, and thereby compromise system safety. In effect, once the switches 212 are set, the system has certain aspects of hardwired inflexibility, due to the inaccessible nature of the switches. However, customization of a particular system for a given installation is a straightforward matter of setting the switches. And the safety which comes with tailoring an input word for the microcomputer to define the number of burners in the system, so that the initial cycling which checks the flame relays for the burners can determine a number for matching against this known and preset number, is a very significant safety feature.

It was noted previously that the digital flame signal on multiplexer output 193 and the limits output for multiplexer 168 were passed to a latch 169. The latch 169 is controlled by the microprocessor via one of the lines of the A port shown at an enable input 220. Another two lines of the latch are shown for entry of manual information via a scan switch diagrammatically illustrated at 221 and an enable switch diagrammatically illustrated at 222. It will be seen that each of the scan or enable lines are grounded when the associated switch is actuated. The state of that switch is set into the latch 169 under the control of control input 220, and read on the I/O bus 170 by the microcomputer when desired. It was noted previously that the operator has the ability to control the control system by use of scan and enable pushbuttons (mounted on the face of the logic module), and the electrical operation of those switches has now been described.

A series of status lights on the face of the logic module 23 was also shown in FIG. 1. Those lights are represented by the LED's illustrated at 230 in FIG. 5. The LED's are controlled via a serial-to-parallel converter 231 which in turn has a control bus 232 driven by the bus 150 of the processor. Thus, the microcomputer 50 is able to latch information into the serial-to-parallel converter 231 which in turn illuminates one or more of the status lights 230. The operating sequences within the microcomputer determine which status lights should be activated, and the mechanism thus far described is the hardware mechanism for controlling the indicators.

A further significant safety feature of the invention resides in the use of watchdog timers which are both software and hardware interrelated. A pair of such timers 240, 241 are provided. In the preferred embodiment, they are 4530 type timers; the resistor/capacitor networks which set the period for the timers is not shown in FIG. 5. Both timers have trigger inputs which are controlled by an output 242 from the microcomputer. Preferably in the illustrated embodiment, the line 242 is the upper bit line of the C Port PC7. However, any output word can be used, so long as the microcomputer 50 drives that line to its active state periodically, within the period established by the timing networks connected to the watchdog timers 240, 241. If the trigger is not serviced within the period of the watchdog timer, the timer will time out, with results to be described below. The fact that the microcomputer 50 has not serviced the watchdog timer within the preset period is an indication that something in the system is amiss; the watchdog timers are configured to cause an appropriate shutdown or a circuit limitation based on the nature of the fault.

The first watchdog timer is an external watchdog timer 240. It has a reset input connected to a power reset module 245. The power reset module is seen to be connected across the main logic power supply bus 246. If the bus 246 has significant negative transients thereon, or if the power supply is briefly interrupted, that will be sensed by the power reset module 245, and will pass a signal to the reset input of watchdog timer 240 which will disable the timer and switch the outputs to the quiescent (untriggered) state. The $\overline{Q}$ output of the watchdog timer 240 is connected through an inverting buffer **240*a* to a fault relay input of the output relay module 160. As will be described in greater detail below, the fault relay input to the module 160 imposes a ground signal directly on the coil of the fault relay, causing the fault relay to be activated. The fault relay is connected so that a normally closed contact set conveys AC power to the majority of the remaining output relays, and through those relays to the actuators in the furnace. When the fault relay coil is energized, the contact set switches, removing power from all of the downstream relays, and thus from the furnace actuators. As a result, in reset (the condition now being described), the fault relay is activated and no power can be passed to the furnace actuators. Similarly, when the watchdog timer 240 times out, the fault relay is also activated to remove power from the downstream relays and thus from the furnace. However, when the watchdog timer 240 is in its triggered state, the fault relay input 248** is high to deenergize the fault relay, allowing the AC power to pass through the normally closed contact set to serve as inputs for the downstream output relays which will controllably pass power to associated elements in the furnace.

In summary, the external watchdog 240 is forced into its reset state whenever the power-on reset module 245 senses a lack of power, and that energizes the fault relay via the fault relay input 248 and removes all output power. When the reset state is removed, the external watchdog 240 is allowed to respond to trigger pulses from the microcomputer. For so long as those trigger pulses are received, the fault relay input 248 to the output relay module remains high to deenergize the fault relay, allowing power to be passed through the fault relay through the remainder of the output relay tree and operate the system. It will also be seen that the fault relay can be operated from the microprocessor itself, and the watchdog timer 240 output 248 is simply one of the signals connected in AND-like fashion which are capable of energizing the fault relay and thus disabling the remainder of the circuit.

The second watchdog timer is a flame watchdog timer 241 which in addition to being triggered by the microprocessor on the trigger input connected to line 242, also has a hardware enabling signal from the digital flame signal produced by multiplexer 191. It will be seen that the output 193 from the digital flame multiplexer is connected as an enabling input to the flame watchdog timer 241 at enabling input 249. The Q output of the flame watchdog timer 241 is connected to a main relay input 250 of the output relay module 160.

So long as the flame signal on output 193 remains low, the flame watchdog timer 241 will continue to respond to trigger pulses to maintain the Q output high. That high Q output will be passed to the input 250 of the output relay module 160. For so long as the input 250 remains high, the main valve relay in the output relay module 160 will be closed, energizing the main fuel valve. If the watchdog timer ever times out, that is if the trigger pulses from the microcomputer 50 are presented to the trigger input at less than the preset period established by the timing components, the flame watchdog timer 241 will time out, and the main fuel valve relay in the output relay module will be immediately deenergized.

As will become more apparent, the software routines associated with the microcomputer 50 are such that at the point in the sequence when the main valve is to be closed, the microcomputer begins to periodically output a logic signal on line 242. That periodic logic signal is intended to trigger the watchdog timers 240, 241 and to maintain those timers triggered. The interval established by the software in the microcomputer 50 is less than the timing interval of the watchdog timers 240, 241. Thus, so long as the software maintains its sanity, trigger pulses will continue to be presented to the watchdog timers 240, 241 before they can time out. Those continued trigger pulses serve as the microcomputer's output to maintain the main valve energized and the fault relay deenergized. If the microcomputer fails to output the trigger pulse at the appropriate frequency, that is taken as an indication that something is amiss in the software, and the watchdog timer 241 will respond in a hardware fashion to simply remove the energizing signal from the main relay, and open the main fuel valve before an accident can occur. Thus, the microcomputer 50 itself need not attempt to analyze the situation and indeed cannot analyze the situation. The requirements are such that the software must output trigger pulses on the line 242 for the entire time the main fuel valve is to remain open. If the operation is such that the trigger pulse stream is interrupted, the watchdog timer 241 opens the main fuel valve, the flame will extinguish, and the system will go into lockout to prevent uncontrolled operation of the furnace.

It will be seen that the flame watchdog timer 241 also has a lockout input 252 which is driven by a particular bit line (one of the A port bit lines) of the microcomputer 50. The connection 252 allows the microcomputer to hold the input 252 low and thereby lock out the flame watchdog timer (maintain the Q output in the low state). That allows the processor to impose a logic signal on the watchdog timer 241 which prevents the main relay from opening in any circumstances, irrespective of trigger pulses. That feature is used in a test mode, for example, when the operator is desirous of determining the quality of each of the pilot flames in the system. The system is allowed to cycle through its sequence of operation through pilot ignition, and the line 252 is used to lock the flame watchdog timer out to prevent the main fuel valve from being energized. That allows the system to hold itself in the flame-on state to allow the operator to check the quality of the flame of each of the pilots, without danger of the sequence continuing through main burner ignition.

Attention will now be directed to an operator's display which is preferably but optionally used in connection with the present invention. The display is shown at 300 at the upper portion of FIG. 5. It is shown as being connected by way of a bus 302 to the microcomputer 50. In a practical implementation, the microcomputer uses primarily port B to drive bus 302 and the operator display. The operator display is a conventional liquid crystal display driven by data received along the bus 302 for presenting various messages as will be described in connection with FIGS. 7A and 7B. In addition, the module 300 has 3 switches, a reset switch 301 for initiating operation, and scan and enter switches (schematically illustrated at 221 and 222 of the drawing). The physical position of the switches is in association with the display 300, and the elements 221 and 222 show their electrical interconnection. Typically, the optional display 300 is installed on the door of the cabinet, and will allow an operator access to the control system in a number of significant respects.

As a final feature of the control system, it will be seen that an output port 305 of the microcomputer 50 is used for connection to a non-volatile memory module 306. The computer 305, in addition to controlling the system as a whole, continues to write status information into the non-volatile memory 306. The information written into the status memory 306 relates to the condition of the digital flame bus and, in some implementations, to the quality of the flames sensed on the bus and input through the analog-to-digital converter. The status of the limits can also be written into the non-volatile memory 306. The nature of the information written into the non-volatile memory 306 depends in some measure on the nature of the control system. Suffice it to say that the information which is related to the status of the system, and which will change in the event of an emergency shutdown, is written into the non-volatile memory 306. That is done by the computer 50 on a continuing basis. In the event of an emergency shutdown, the microcomputer 50 stops writing information into the non-volatile memory 306, and significantly stops erasing information from that memory. Even if power is removed from the system, the non-volatile memory 306 has storage for sufficient status information to report to a technician the status of the system at the time and just before the time of the system failure. The reset, scan and enter switches of the display 300 are used for reading the information in the non-volatile memory 306 so that a technician can determine the nature of the shutdown. Of course, the non-volatile memory 306 contents can also be read into a processor which is connected to the microcomputer 50 via one of the communication ports.

It will be noted in passing that the communication ports are not illustrated in FIG. 5, since their connection to and interface with a microcomputer is conventional, and nothing out of the ordinary is required in a system according to the present invention. The features that are provided, which are important and novel, however, are the provision of sufficient status information in the non-volatile memory 306 which is available either to the operator using the display and scan switches, or via the communication port, so that failure information can be analyzed (manually or statistically) so as to improve furnace and control operation.

The non-volatile memory 306 is an option in the sense that it contains the same information which is written into a status section of the microcomputer memory (a portion of section 50*b* (FIG. 2)). In normal operation, as the microcomputer continues to scan the flame relay modules, the information from the digital flame bus and analog flame bus are read into the microcomputer 50. That information is written into the status section of memory 50*b*, and, when present, into the non-volatile memory 306. As noted above, other status information can also be stored. In the event of a flame failure, the microcomputer 50 is programmed to stop writing additional information into the status memory, so that the status information at the time of the flame failure is retained. That status information includes recent historical information on the remainder of the flames, as well as the status information on the flame which had failed. Thus, if power is not removed from the microcomputer 50, the information in status memory 50*b* is available for readout and analysis to determine whether other system faults contributed to the flame failure. The non-volatile memory 306 is a further backup, containing some of the same information, but in a form which will not be lost in the event power to the system is removed.

Figure 6:
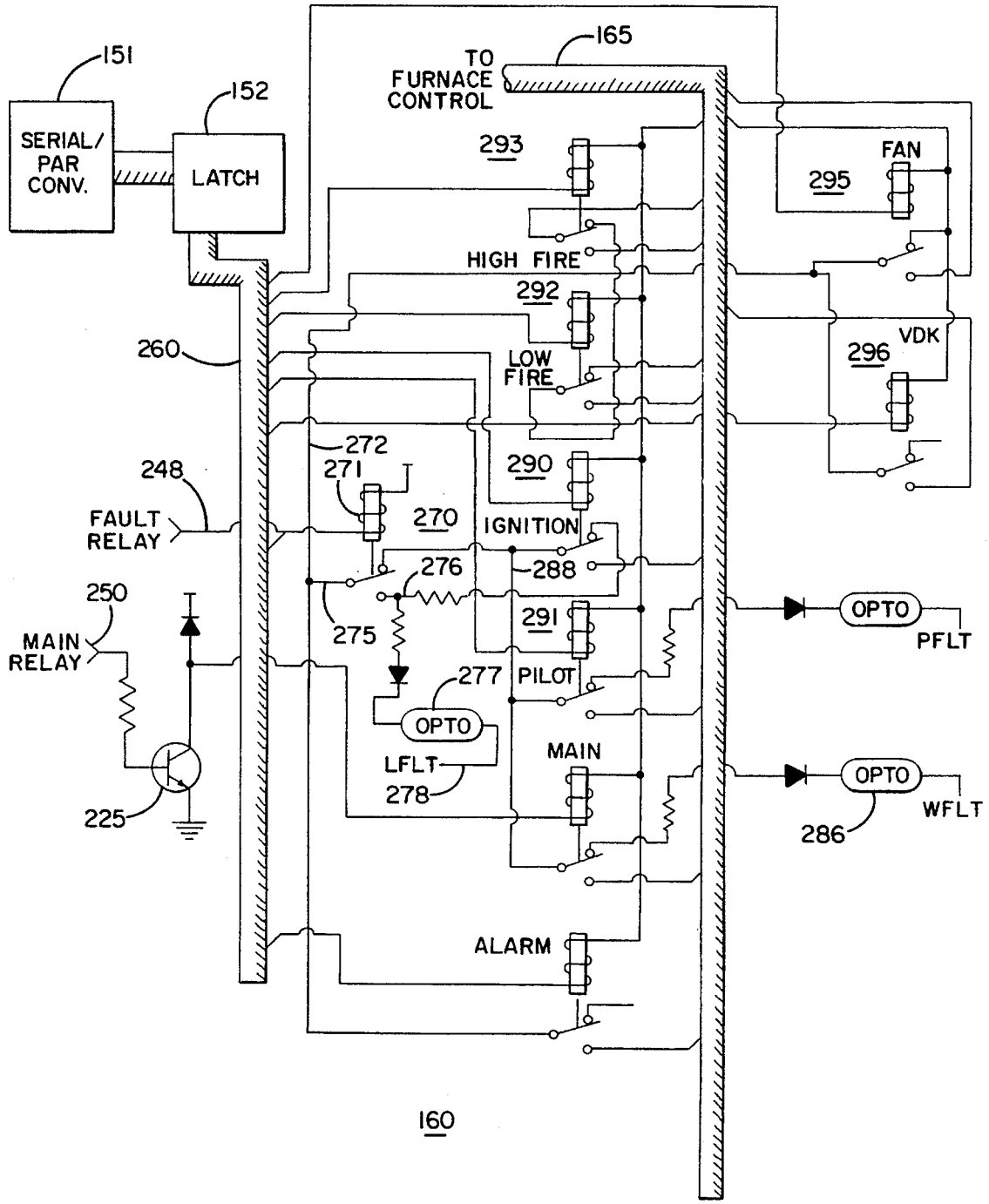
FIG. 6 is a schematic diagram illustrating a relay module used in the system of FIG. 5.

Turning then to FIG. 6, there is shown the details of an exemplary embodiment of an output relay module 160. The serial-to-parallel converter 151 and latch arrangement 152 previously illustrated on FIG. 5 are shown to the left of FIG. 6. The output bus 260 of the latch module is connected to the input of the relay module 160. It will be understood that the output bus 260 has 8 conductors, and they are connected to the coils of 8 of the 9 relays in the relay module 160. The only coil which does not have a connection from the processor itself is the main valve relay as will be described below.

Looking to the left of the module 160, it will be seen that the first relay illustrated there is the fault relay 270. The fault relay has a coil 271 which is driven from the module fault input 248, such that the fault relay will be energized whenever the input 248 is low (i.e., $\overline{Q}$ high). Normally when the system is operating in accordance with the program, the output 248 will be high and the fault relay 270 will remain deenergized. An input 272 from the latch 152 also allows the processor to control the fault relay directly, in addition to the control 248 (which it is recalled is via the external watchdog timer 240). The contact set of the fault relay has the AC line connected to a common input 275. In the normal deenergized condition, AC power is thus passed through the normally closed contacts to the remainder of the relay tree. In a fault condition (as controlled either by the processor or by the external watchdog timer 240, the fault relay 270 will be energized. The contact set will switch, removing AC power from the remainder of the relay tree. When the contact set switches, the AC power is then placed on the output 276 which creates a signal through optoisolator 277 to provide an active signal on line LFLT (identified by reference numeral 278). That line is scanned by use of a multiplexer and input latch 169 (FIG. 5) so that it is for input to the microcomputer 50. Thus, the microcomputer will have status information via the line LFLT whenever the fault relay is energized. Similarly, the lack of a signal (or a low signal) on the line LFLT indicates that the fault relay is in its normal operating deenergized condition.

Turning to the remainder of the relays in FIG. 6, the lowermost relay 280 in the relay string is an alarm relay. When driven by the appropriate line from the latch 152, the alarm will be activated, connecting AC power (derived through the input AC line) to an output line in the furnace control bus 165. An alarm in the furnace will be energized.

Positioned above the alarm relay is the main valve relay 284. The coil of the main valve relay is driven through a buffering transistor 285 from the input signal 250 (from the flame watchdog timer 241). In normal operation, when the Q output of the flame watchdog timer 241 is high, the transistor 285 will be on, and that will energize the coil of the main relay 284. It will be appreciated that the Q output of the flame watchdog timer is high only when the microcomputer is providing a string of triggering pulses to the watchdog timers commanding the watchdog timer 241 to energize the main fuel valve. It will be seen that the contact set of the relay 284, when switched to its alternate condition, provides an output into the furnace control bus 165 which is routed to the main fuel valve to actuate that valve. Whenever the main valve relay is deenergized (as by lack of trigger pulses from the microprocessor or by lack of a flame signal on the digital flame line 193), the relay set will be in the condition shown in FIG. 6. The AC power (which had been passed through the contact set of fault relay 270) will be applied through an optoisolator 286 to provide a signal on output line MFLT, sensed by the processor through multiplexers and the latch 169 to indicate that the main valve relay is deenergized.

Examining the fault relay again, it will be seen that even when the main flame relay is activated in response to appropriate triggering of the watchdog timer 241, if a fault is detected (either by watchdog timer 240 or software), the fault relay 270 will be energized (either via input 248 or computer control line 272). Energization of the fault relay will switch the contact set, removing the source of AC power from a junction 288. Thus, the power which had been used to energize the coil of the main valve will be removed, causing the main valve to open and disconnect the supply of fuel.

The safety features will thus be apparent. In order to open the main valve, both the software and the hardware must function properly in order to switch the contact set of the main valve relay 284 to switch AC power through the output bus 165 to energize the coil of the main fuel valve. If the flame signal fails or if the software loses its sanity, the flame watchdog timer 241 will remove the input signal from transistor 285 which in turn will drop out relay 284, removing the source of power for the main fuel valve. Similarly, if a fault is detected, the fault relay 270 will be energized, and that in turn will remove power from the junction 288, and thus deenergize the main fuel valve. In either case, the main fuel valve must open, removing the source of fuel and potentially a dangerous situation from uncontrolled admission of fuel into the furnace line.

The remaining relays are used in the ordinary sequencing of the system and will be described only briefly. An ignition relay 290 has a coil driven from the latch 152 and an output which is coupled into the furnace bus 165. Energization of the ignition relay 290 at the appropriate time will cause a spark to be generated which is intended to ignite the fuel admitted through a pilot fuel valve. The pilot fuel valve in turn is controlled by a relay 291. The relay 291 has a coil driven from the latch 152 and an output coupled into the furnace control bus 165. At the appropriate point in the sequence, the relay 291 will be energized to supply power to the pilot valve, thereby causing the pilot valve to open, admitting fuel into the pilot orifice. The ignition relay 290 will be activated to cause a spark through the igniter and ignite the pilot flame. The flame relay modules 180–181 provide signals back to the processor so that the presence of flames can be checked as the sequence progresses.

A low fire relay 292 and a high fire relay 293 are provided for use in modulation control. Modulators used with such furnaces tend to modulate the flame by control of relays such as 292, 293. The relays, like the relay 290 just described, have coils driven from the latch 152, and outputs present in the furnace control bus 165. Appropriate valves and dampers are controlled by the power signals from those relays as is conventional. A fan relay 295 is also driven from the latch 152 and has an output in the furnace bus 165 for controlling power to a fan motor. Air switches in the system provide signals back through the limits (described previously) to determine that air is proven. A VDK relay 296 is also provided controlled from the computer via latch 152 as the others, and having an output in the furnace control bus 165. The VDK relay operates in conjunction with a particular type of valve in the furnace intended to assure a leakproof valve closure.

Those skilled in the art will appreciate the remaining intricacies of the interconnections between the relays in the system intended to assure the measures of interconnecting redundancy normally associated with a furnace. The additional safety features provided by the interrelationship between the microprocessor (FIG. 5) and the details of the relay module 160 have also now been described.

Figure 7A:
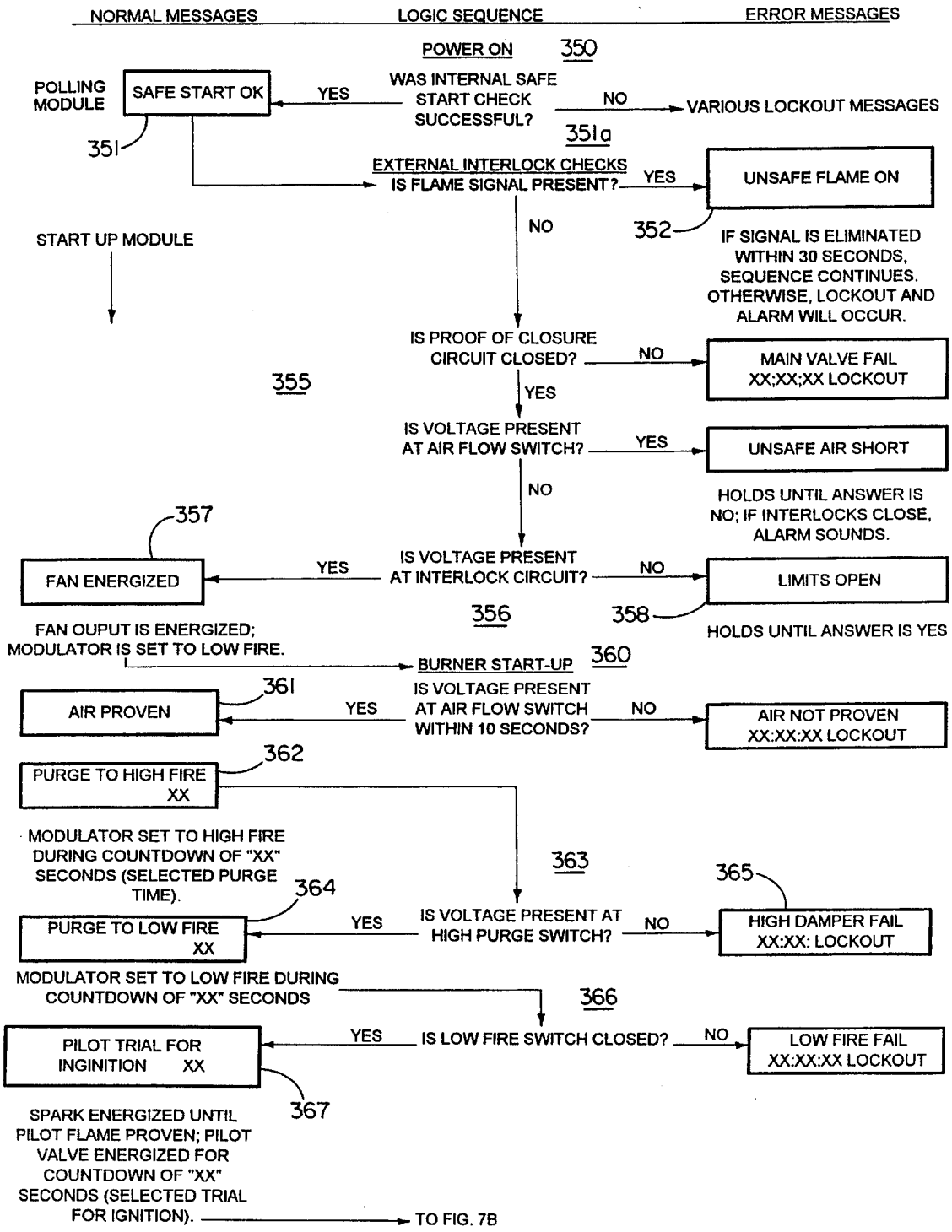
FIGS. 7A and 7B are flowcharts illustrating the sequencing of the system constructed in accordance with the present invention.
Figure 7B:
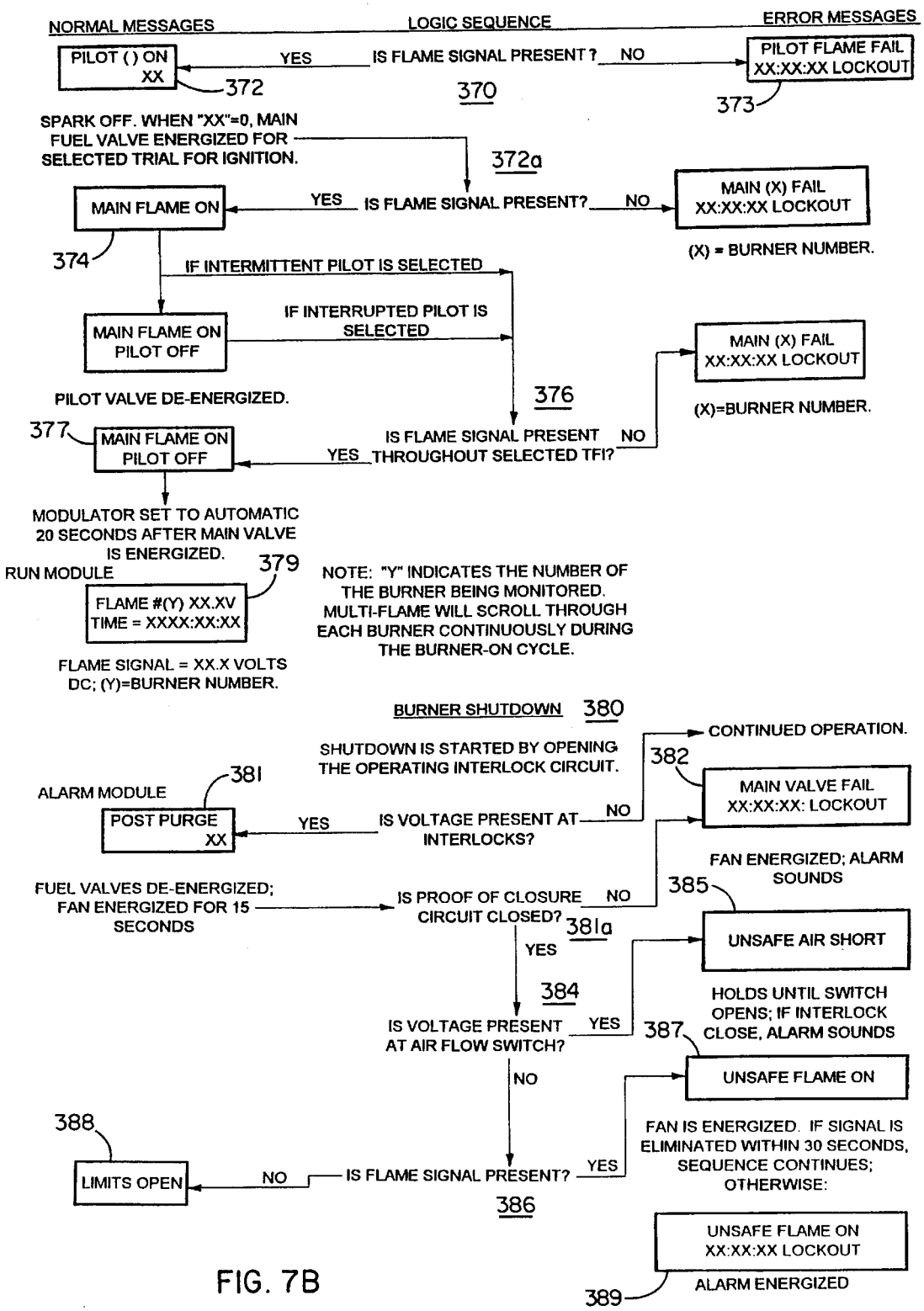

Attention will now be directed to the sequencing of the system and the points at which failures can occur and failure messages displayed. Reference is made to FIGS. 7*a* and 7*b* for the sequence of operation. The drawings are relatively self-explanatory, and contain a significant number of descriptive legends, which will not be repeated verbatim herein.

FIGS. 7A and 7B are divided into three columns, with the center column indicating the logic sequence which is being performed by the control system in concert with the furnace. The left column illustrates normal messages, that is, messages displayed on the display panel 300 during normal operation of the system. In the event of a system failure or malfunction, error messages are displayed, and those messages are indicated in the right-hand column. Thus, as shown in FIG. 7*a*, the sequence starts at a step 350 in which power is applied. In a polling module of the overall system program, the processor performs certain checks of internal relays to assure that the system is functional. For example, while maintaining the watchdog timer deenergized, the processor causes the relays within the relay module 60 to be cycled in a predetermined sequence, and monitors the output contacts to assure that the system is functional. In addition, utilizing the test bus 207 for control and the digital flame bus 190 for sensing, each of the flame relay modules is cycled. These tests assure that the contacts in the relays (both the relay array 160 and the flame relays) are not welded and are functional. In addition, with respect to the flame relays, the system counts the number of relays which are functional, and matches the number counted to the number set on the input switches 210 (FIG. 5). When all of those checks prove out, the system has successfully completed the tasks of the polling module, and progresses to display the message 351 to indicate that a safe start is okay. Lockout messages are provided in the alternate condition, i.e., if faults are detected.

In commencing the program sequence of the startup module, the external interlocks check 351 senses the interlocks in the furnace system. The presence of a flame signal can indicate either a flame in the furnace where none is intended or, alternatively, a defective flame relay. If either is detected, the unsafe flame message 352 is displayed.

The process controlled by the sequence in the microcomputer then progresses through the steps generally indicated at 355 to ultimately test the fault relay 270 (FIG. 6) to determine if voltage is present at the interlock circuit in a step 356. If it is, the sequence progresses to display a message 357 indicating the fan is energized. An error message 358 is displayed if the interlock does not have voltage present.

Assuming the system is sequencing properly, the system then progresses to the steps beginning at 360 for ordered burner startup. Assuming the fan has started and the air switch has proven the air flow, the air proven message 361 will be displayed, following which the system will progress to the purge to high fire message. The time of the high fire purge is individually selectable by switches within module 210, and a number of seconds for the high fire purge is displayed. The appropriate limit switch is tested at step 363 and if the test proves acceptable, the purge to low fire message 364 is displayed. If the test 363 fails, the error message 365 is displayed. The purge to low fire time is also selectable by switch module 210, and the number of seconds for the low fire purge is displayed in the message 364. After the end of that period, and assuming the limit for the low fire switch tests positive at the step 366, the message 367 is displayed indicating that a pilot trial for ignition is in effect. The pilot valve will be energized for a countdown of the displayed number of seconds (selectable by the module 210). The spark will be energized for that period of time until the pilot flame is proven as determined in the step 370 (FIG. 7B). The flame signal present is, of course, determined by the microcomputer scanning the DFL bus from the multiplexer to sense the signals originating from the flame modules. If the flame signal is present, the normal message 372 is displayed indicating that the pilot in question is on. The error message is indicated at 373. The main valve is then energized, and a step 372 is performed to determine if the main flame signal is present. That is also determined by scanning of the flame relays, as will now be apparent. If the main flame is detected, the message 374 so indicates to the operator. Depending on whether intermittent pilot or interrupted pilot is selected (via the module 210), the system progresses to a test 376 to assure that the main flame is on, and the message 377 is displayed. After the main flame is displayed for an appropriate period of time, control passes to the modulator and the system operation advances to the run module. In the run module, the microcomputer 50 continues to cycle the analog multiplexer 196 through the respective channels, and will cause a sequence of displays 379 to indicate the quality of each of the flames. It will be seen that the display shows both the number of the burner (y), the voltage associated with the quality of that flame, and the time at which the reading was taken. That information is continually stored and updated in the status memory **50*b* , and in the non-volatile memory 306** if present. The furnace will continue to operate with continual checking of the flame quality by the system and continual updating of the status memory. If no faults occur, the system will continue to operate until it is intentionally shut down. If, however, a fault occurs, the program will branch to the alarm module, and an automatic shutdown will occur. Importantly, the contents of the status memory will be retained for use in determining the nature of the shutdown.

Once a shutdown sequence is indicated (see the bottom of FIG. 7B), that shutdown is indicated by opening of one of the operating interlock circuits, such as the fault relay 270 (FIG. 6). The opening of the interlock (fault relay) is indicated at the step 380. A post-purge message is displayed at 381. The fuel valve will be automatically deenergized, and fan operation continued to purge the system. If the test 381 indicates that the flame watchdog timer 241 has timed out, an error message 382 indicating a main valve failure is displayed. The message indicates that the system is in lockout, and the time at which the failure occurred. A test 384 determines, by sensing the limits, whether the fans are still on, and if so, an error message 385 is displayed. A test 386 is then performed to determine if any of the flames remain present. If a flame remains present, a message 387 so indicates. If the system has shut down in an orderly fashion, a display 388 indicates that the system is ready for restart. A final message 389 is provided in the event the unsafe flame signal is not eliminated within 30 seconds. That message, with the sounding of an audible alarm, indicates that a flame is still on in the system even though the system should be shut down. Immediate operator attention is required.

As one example of additional operator control provided in a system according to the invention, not available in systems, of the past, the operation of setting and adjusting the pilot flames will be described. In that operation, the orderly startup sequence of FIG. 7A is performed, including invoking the polling module and the startup module. However, in the startup module, the sequence is terminated prior to energizing the main fuel valve. The lockout line 252 to the flame watchdog timer 241 is maintained low, so that it is impossible to create a signal 250 to energize the main valve relay. The sequencing stops at about the step 370, and prevents the generation of trigger pulses to the watchdog timers for energization of the main valve. At that point, the software then branches to a step similar to the steps 376–379. Those steps sequence through the pilot burners in turn, and cause the microcomputer 50 to operate with analog-to-digital converter 200 to measure the signal level associated with each pilot flame. The operator can utilize the scan button to sequence through the pilot flames in turn, and can make appropriate adjustments in the furnace to achieve pilot flames at the desired level. As much time as is needed can be taken in that operation without concern that the system will inadvertently open the main valve and cause ignition of one or more of the main burners.

A number of additional interrupted sequence or altered sequence modes of operation for a system in accordance with the present invention will now become apparent to those skilled in the art, based on the foregoing description and the description of the pilot adjust altered sequence.

It will now be appreciated that what has been provided is a control system for a multiple burner furnace which has the flexibility normally associated with a microcomputer control system, but the safety normally associated with a hardwired dedicated system. The safety features, interlocks and interconnections described in detail above are capable of achieving hardwired-like reliability, while the microprocessor control provides added flexibility, but without the flexibility reducing the safety features of the system. The ability of the system to record status information occasioned at the time of a flame failure provides data readily available to a technician which is more complete than has been provided heretofore. The technician will not only know the burner which failed and the time at which it failed, but will also have available to him additional status information from the system so that a more complete analysis of the flame failure can be provided, and appropriate corrective steps taken.

What is claimed is:

1. A control system for a plurality of burners in a multiple burner industrial furnace having a plurality of burners with associated fuel supplies distributed in said industrial furnace, the control system comprising, in combination:

a plurality of electronic flame sensors, each having an input for connection to a flame sensing transducer exposed to a flame to be sensed, each having an output for producing an electronic level signal indicative of the sensed flame, and each having a test input for polling by an electronic processor;

an electronic programmable processor having a set of program modules which include:

a polling module operative on the flame sensor test inputs for detecting the presence of a flame sensor for each burner and checking initialization conditions for each burner before startup;

a startup module for initiating burner firing, the startup module including purge and ignite sequences;

a run module including means for polling the flame sensors to monitor the flames sensed by the associated transducers; and an alarm module for orderly shutting down of the system upon detection of a lost flame from an extinguished burner and recording the identity of the extinguished burner and the time at which the burner extinguished;

memory means associated with the processor for recording status information at the time of occurrence of an alarm condition, the status information including the identity of any extinguished burner and the time at which said extinguished burner extinguished.

2. The combination of claim 1 wherein the electronic programmable processor includes manually settable means for specifying the number of flame sensors in a particular system, and the polling module compares the number of detected flame sensors against said specified number, and initiates a lockout condition in the event of mismatch.

3. The combination as set forth in claim 1 wherein the memory means includes non-volatile memory means for storing status information on the system, the non-volatile memory means having sufficient capacity to store information on all burners and maintain said storage in the event of power failure upon system shutdown.

4. The combination as set forth in claim 1 in which each flame sensor includes an output relay associated with an output circuit for energizing the relay when the sensing transducer detects a flame, the test inputs of the flame sensors being driven by the processor for simulating the presence of a flame to thereby switch the relay from the de-energized to the energized condition, the processor monitoring the flame sensor outputs during the course of said switching to detect failed relays.

5. The combination as set forth in claim 1 wherein the memory means includes a plurality of words of storage for storing information regarding system faults as they are detected for later scanning of the stored fault information to detect patterns therein.

6. The combination as set forth in claim 1 wherein the processor further has a display port for connection to a remote display, and a display connected to said display port and driven by the processor for displaying messages initiated from the processor.

7. The combination as set forth in claim 1 in which the control system includes a flame watchdog timer triggered by the programmable processor and having an output serving as an enabling signal for a main fuel valve relay, the main fuel valve relay connected as the only means for energizing the main fuel valve in the furnace, the processor in the startup and run module including means for providing trigger pulses to the flame watchdog timer and as a signal to energize the main fuel valve relay.

8. The combination as set forth in claim 7 in which a flame present signal generated by the run module when polling the flame sensors is operatively associated with the flame watchdog timer to enable the flame watchdog timer to respond to trigger pulses from the processor only in the presence of the flame present signal.

9. The combination as set forth in claim 8 wherein the flame watchdog timer has a reset input, and means coupling the reset input to the processor for enabling the flame watchdog timer in a normal mode to sense the flame present signal and respond to trigger pulses to energize the main fuel valve relay.

10. The combination as set forth in claim 9 including a further watchdog timer having a trigger input connected to the microcomputer for being serviced periodically within the time constant of the further watchdog timer, an output from the further watchdog timer being connected to a fault relay for control thereof, the fault relay having a contact set which passes power to output relays which control the industrial furnace, the output of the watchdog timer serving to energize the fault relay and open the supply of power in the event the further watchdog timer is not triggered by the processor.

11. The combination as set forth in claim 1 including an analog-to-digital converter associated with the processor and with the flame sensors, a multiplexer connected to an analog signal from the flame sensors indicative of flame quality, and having an output connected to the analog-to-digital converter for digitizing flame quality signals and passing them to the processor for storage.

12. A control system for a plurality of burners in a multiple burner industrial furnace having a plurality of burners with associated fuel supplies distributed in said industrial furnace, the control system comprising, in combination:

a plurality of electronic flame sensors, each having an input for connection to a flame sensing transducer exposed to a flame to be sensed, each having an output for producing an electronic level signal indicative of the sensed flame, and each having a test input for polling by an electronic processor;

an electronic programmable processor having a port connected to the plurality of electronic flame sensors for:

(a) sensing the presence and quality of the flames sensed by the flame sensors;

(b) signalling the flame sensors and testing the operability thereof; and (c) determining if the number of operable flame sensors is the same as a predetermined number of flame relays for the number of burners in the furnace;

the processor having a further port for connection to a plurality of output relays for controlling the industrial furnace, the output relays including a main valve relay for controlling the fuel flow to the main burners of the furnace, and a fault relay interlocked with the output relays for interrupting the power supply to the output relays in the event a fault is detected;

an external watchdog timer being connected to the processor for triggering thereby at a rate greater than a predetermined time constant established for the external watchdog timer, the external watchdog timer having an output connected to the fault relay for disabling the fault relay and removing power from the output relays in the event the processor fails to trigger the external watchdog timer more frequently than the predetermined interval; and a flame watchdog timer having a time constant and being connected for triggering by the processor at a rate greater than said time constant, hardware means connecting the flame watchdog timer to the electronic flame sensors for disabling the flame watchdog timer in the event one or more flame sensors fail to sense a flame, an output from the flame watchdog timer connected to the main valve relay whereby if the flame fails or the processor fails to trigger the flame watchdog timer the main valve relay opens the circuit to the main valve thereby preventing fuel flow to the furnace.

13. The combination as set forth in claim 12 further including an external alphanumeric display, a display port on the processor, and a cable connecting the external display to the display port, the processor serving to drive the display port with messages indicating the status of the system for display to an operator.

14. The combination as set forth in claim 12 further including manually settable switch means connected to a port of the processor, the manually settable switch means including means for fixedly setting a number corresponding to the number of burners in the system, the processor including means for cycling the test inputs of the flame relays to determine the number of operative flame relays in the system, and matching said determined number against said fixedly set number.

15. The combination as set forth in claim 12 in which the memory means records additional status information, including the status of all burners in the system at the time of recording an alarm condition, and means for preventing updating of the status information in the event an alarm condition is detected.

16. The combination as set forth in claim 15 in which non-volatile memory means are associated with the memory means and driven by the processor to record said status information, so that said status information is available in the event of a power failure.

17. The combination as set forth in claim 12 including an analog-to-digital converter associated with the processor and with the flame sensors, a multiplexer connected to the signal from the flame sensors indicative of flame quality, and having an output connected to the analog-to-digital converter for digitizing flame quality signals and passing them to the processor for storage.

* * * * *